US011495897B2

(12) United States Patent
Yamamoto

(10) Patent No.: US 11,495,897 B2
(45) Date of Patent: Nov. 8, 2022

(54) ELECTRIC CONNECTION PART

(71) Applicant: YAZAKI CORPORATION, Tokyo (JP)

(72) Inventor: Hirotaka Yamamoto, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/152,828

(22) Filed: Jan. 20, 2021

(65) Prior Publication Data

US 2021/0226358 A1 Jul. 22, 2021

(30) Foreign Application Priority Data

Jan. 21, 2020 (JP) ..... JP2020-007492

(51) Int. Cl.

| | |
|---|---|
| ***H01R 9/24*** | (2006.01) |
| ***H01R 25/16*** | (2006.01) |
| ***H01R 9/22*** | (2006.01) |
| *H01R 11/12* | (2006.01) |

(52) U.S. Cl.

CPC ..... *H01R 9/2416* (2013.01); *H01R 9/223* (2013.01); *H01R 25/162* (2013.01); *H01R 11/12* (2013.01)

(58) Field of Classification Search

CPC ..... H01R 11/12; H01R 2105/00; H01R 4/30; H01R 9/24; H01R 13/521; H01R 4/34; H01R 13/405; H01R 13/4223; H01R 13/516; H01R 13/6215; H01R 2201/26; H01R 11/281; H01R 9/2416; H01R 9/223; H01R 25/162; H01L 23/24; H01L 2924/00; H01L 2924/0002; B29C 45/14639; F16B 17/00; F16B 37/04; F16B 37/048; F16B 37/068; F16B 4/004

See application file for complete search history.

(56) References Cited

U.S. PATENT DOCUMENTS

| | | | | |
|---|---|---|---|---|
| 5,795,117 | A * | 8/1998 | Onoda | F16B 37/04 411/104 |
| 6,464,538 | B2 * | 10/2002 | Miyazaki | H01R 13/6589 439/607.44 |
| 8,702,361 | B2 * | 4/2014 | Akuta | B29C 45/14639 411/103 |
| 9,390,987 | B2 * | 7/2016 | Oose | H01L 23/051 |
| 9,967,994 | B2 * | 5/2018 | Ikezawa | H05K 7/1432 |
| 10,062,974 | B2 * | 8/2018 | Okamoto | H01R 13/6581 |
| 10,082,171 | B2 * | 9/2018 | Yamauchi | F16B 4/004 |
| 2014/0322973 | A1 * | 10/2014 | Okamoto | H01R 13/4223 439/587 |
| 2018/0323521 | A1 * | 11/2018 | Yokotani | H01R 9/18 |

FOREIGN PATENT DOCUMENTS

| | | |
|---|---|---|
| JP | 2011-176928 A | 9/2011 |
| JP | 2011-239600 A | 11/2011 |

* cited by examiner

*Primary Examiner* — Briggitte R. Hammond
(74) *Attorney, Agent, or Firm* — Kenealy Vaidya LLP

(57) ABSTRACT

There is provided an electric connection part including: a nut made of a metal, the nut being used for fixing a conductor; and a housing made of a resin, the housing having a press-fit groove into which the nut is press-fitted. The housing includes: a rib that protrudes from an inner side surface of the press-fit groove and extends along a press-fitting direction in which the nut is press-fitted into the press-fit groove, such that the rib presses the nut to be in contact with the nut; and a recess that is disposed on an extension line in which the rib extends, the recess being recessed in the press-fitting direction.

7 Claims, 5 Drawing Sheets

ELECTRIC CONNECTION PART

CROSS-REFERENCE TO RELATED APPLICATIONS

This application is based on and claims priority under 35 USC 119 from Japanese Patent Application No. 2020-007492 filed on Jan. 21, 2020, the contents of which are incorporated herein by reference.

TECHNICAL FIELD

The present disclosure relates to an electric connection part including a nut made of metal and a housing made of resin into which the nut is press-fitted.

BACKGROUND ART

In the related art, an electric connection part is proposed in which a nut made of metal for bolt fastening and fixing a conductor, such as a terminal, is embedded in a housing made of resin. This type of electric connection part can be used, for example, as a so-called terminal block for forming a power circuit for a vehicle or the like. For example, one of electric connection parts in the related art is further provided with a groove on a bottom surface of a recess provided in the housing, and the nut itself embedded in the recess and a bolt fastened to the nut are used to block an opening of the groove on the bottom surface of the recess. Accordingly, metal powder that can be generated by scraping a surface of the bolt or the nut at the time of fastening is accommodated in the groove on the bottom surface of the recess, and an occurrence of a defect caused by the metal powder in a circuit to which the electric connection part belongs or an electric device around the electric connection part is prevented (see, for example, JP2011-176928A).

An example of a method of embedding the nut made of metal in the housing made of resin includes a method of press-fitting the nut into a press-fit groove provided in the housing. When the method is used, by bringing the nut into contact with an inner wall surface of the press-fit groove at the time of press-fitting, the housing having a relatively low strength (that is, the inner wall surface of the press-fit groove) may be scraped by the nut to generate resin pieces. The resin pieces can cause various defects from a viewpoint different from the above metal powder. For example, when the resin pieces are scattered in a bolt fastening hole of the nut, the resin pieces may interfere with fastening of the bolt and the nut. In addition, for example, when the resin pieces are scattered at a contact portion of the electric connection part, the resin pieces may interfere with proper electric connection. Therefore, when the nut is press-fitted into the housing, it is desirable to prevent the resin pieces that may be generated at the time of the press-fitting from scattering around as much as possible.

SUMMARY OF INVENTION

The present disclosure provides an electric connection part capable of preventing scattering of resin pieces that can be generated when a nut is press-fitted into a housing.

According to an aspect of the present disclosure, an electric connection part includes: a nut made of a metal, the nut being used for fixing a conductor; and a housing made of a resin, the housing having a press-fit groove into which the nut is press-fitted. The housing includes: a rib that protrudes from an inner side surface of the press-fit groove and extends along a press-fitting direction in which the nut is press-fitted into the press-fit groove, such that the rib presses the nut to be in contact with the nut; and a recess that is disposed on an extension line in which the rib extends, the recess being recessed in the press-fitting direction.

The present disclosure has been briefly described as above. Details of the present disclosure is further clarified by reading a mode (hereinafter, referred to as "embodiment") for carrying out the disclosure described below with reference to attached drawings.

DESCRIPTION OF EMBODIMENTS

Embodiment

Figure 1:
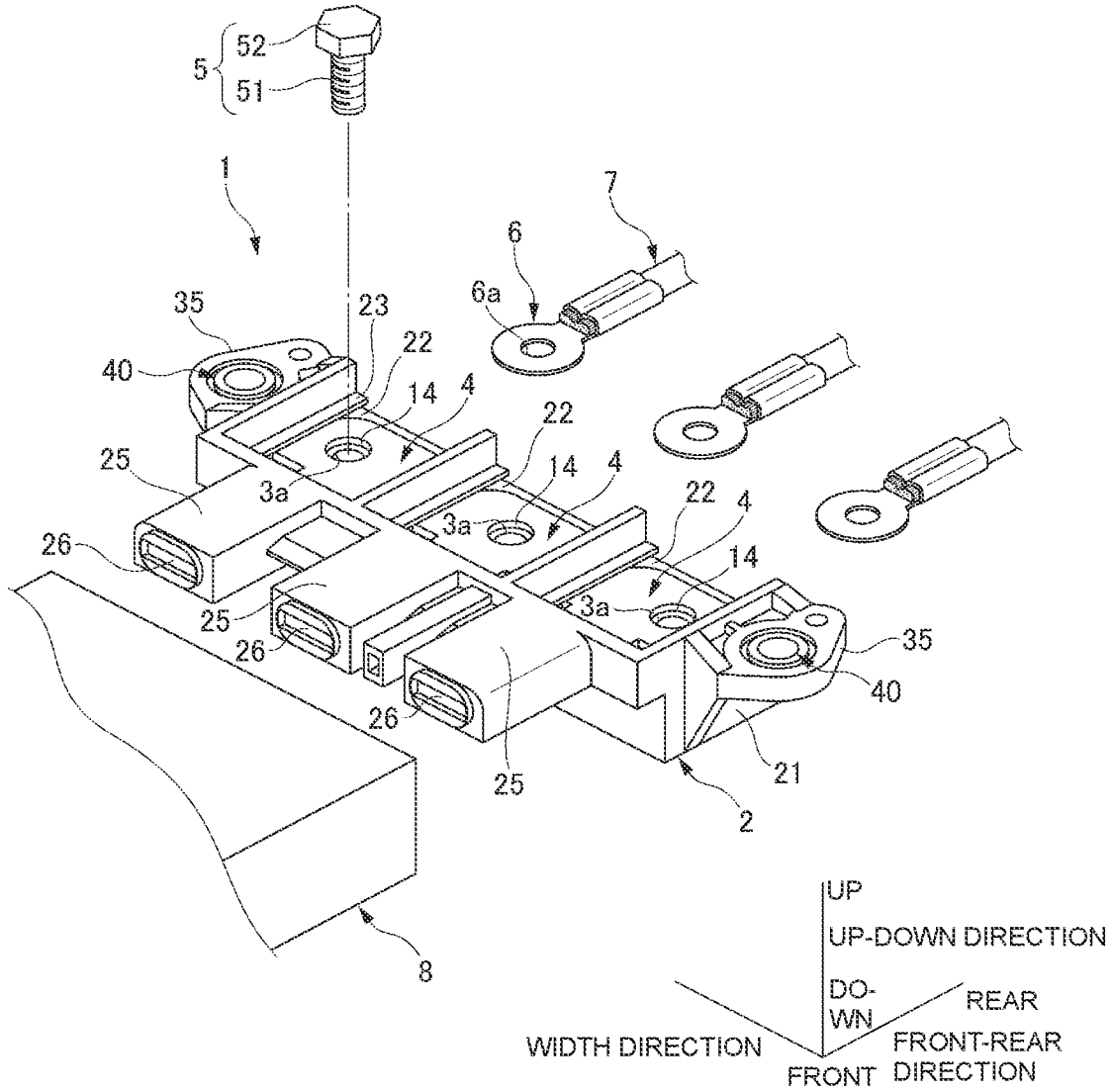
FIG. 1 is a perspective view showing an electric connection part according to an embodiment of the present disclosure, a plurality of terminals provided on terminals of a plurality of electric wires, and a counterpart connector.

Hereinafter, an electric connection part 1 according to an embodiment of the present disclosure will be described with reference to the drawings. As will be described later, the electric connection part 1 shown in FIG. 1 is used as a relay connector that conducts a predetermined circuit after fixing a terminal 6, and is generally referred to as a terminal block. Therefore, the electric connection part 1 is hereinafter also referred to as a "terminal block 1". The terminal block 1 is typically mounted on a vehicle and is used to configure a power supply system circuit. The terminal block 1 is configured to electrically connect a plurality of terminals 6 provided on terminals of a plurality of electric wires 7 extending from various electric components (not shown) and a counterpart connector 8 via a bus bar 4. The terminal 6 is a so-called eyeglass terminal having a circular flat plate shape, and a through hole Ca penetrating in a plate thickness direction is formed in a center portion of the terminal 6.

Hereinafter, for convenience of description, as shown in FIGS. 1 to 5, "front-rear direction", "width direction", "up-down direction", "front", "rear", "up", and "down" are defined. The "front-rear direction", the "width direction", and the "up-down direction" are orthogonal to one another. The front-rear direction matches a fitting direction of the terminal block 1 and the counterpart connector 8.

Figure 2:
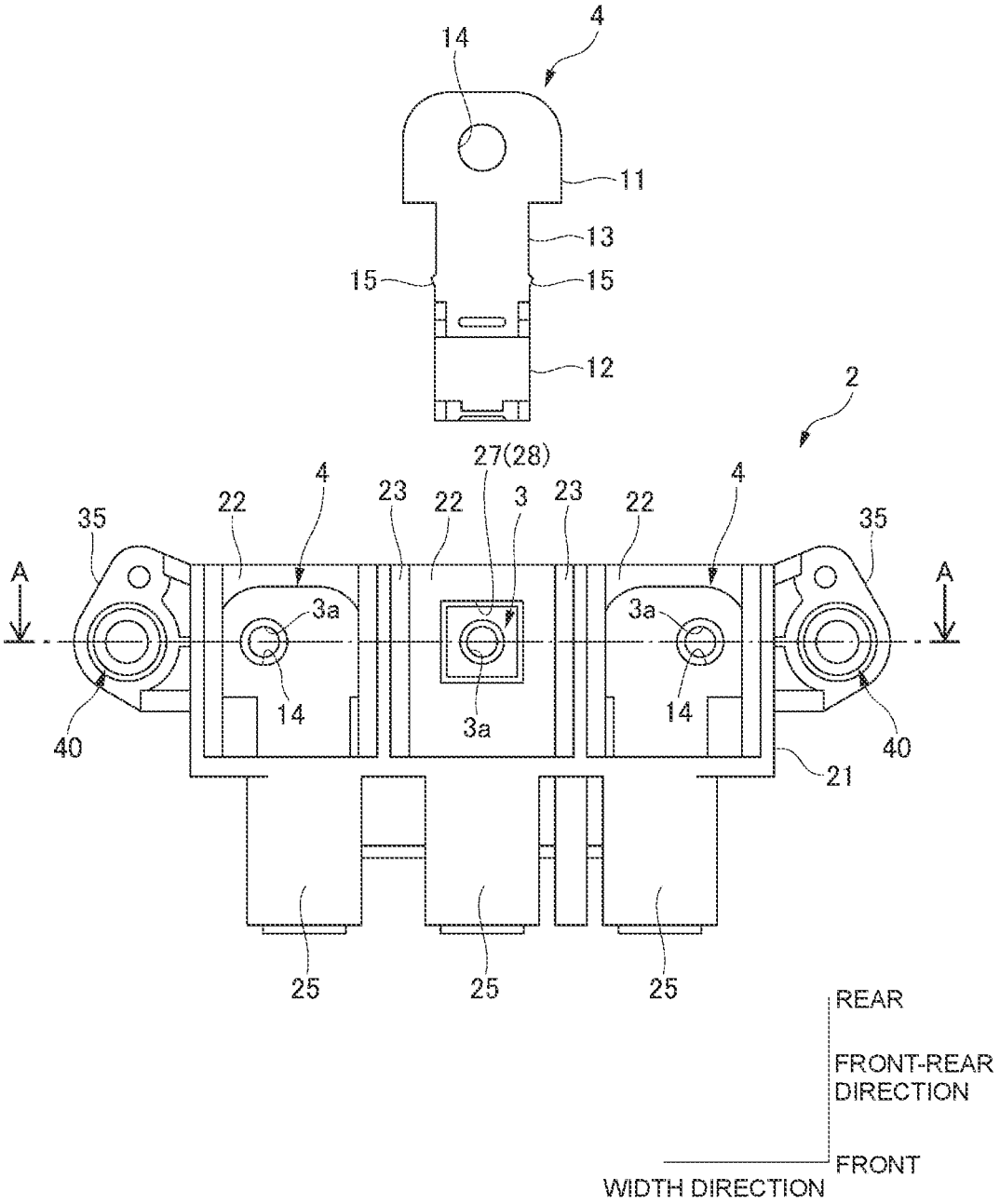
FIG. 2 is a top view of the electric connection part shown in FIG. 1 (in which one of a plurality of bus bars is shifted in order to illustrate a nut).
Figure 3:
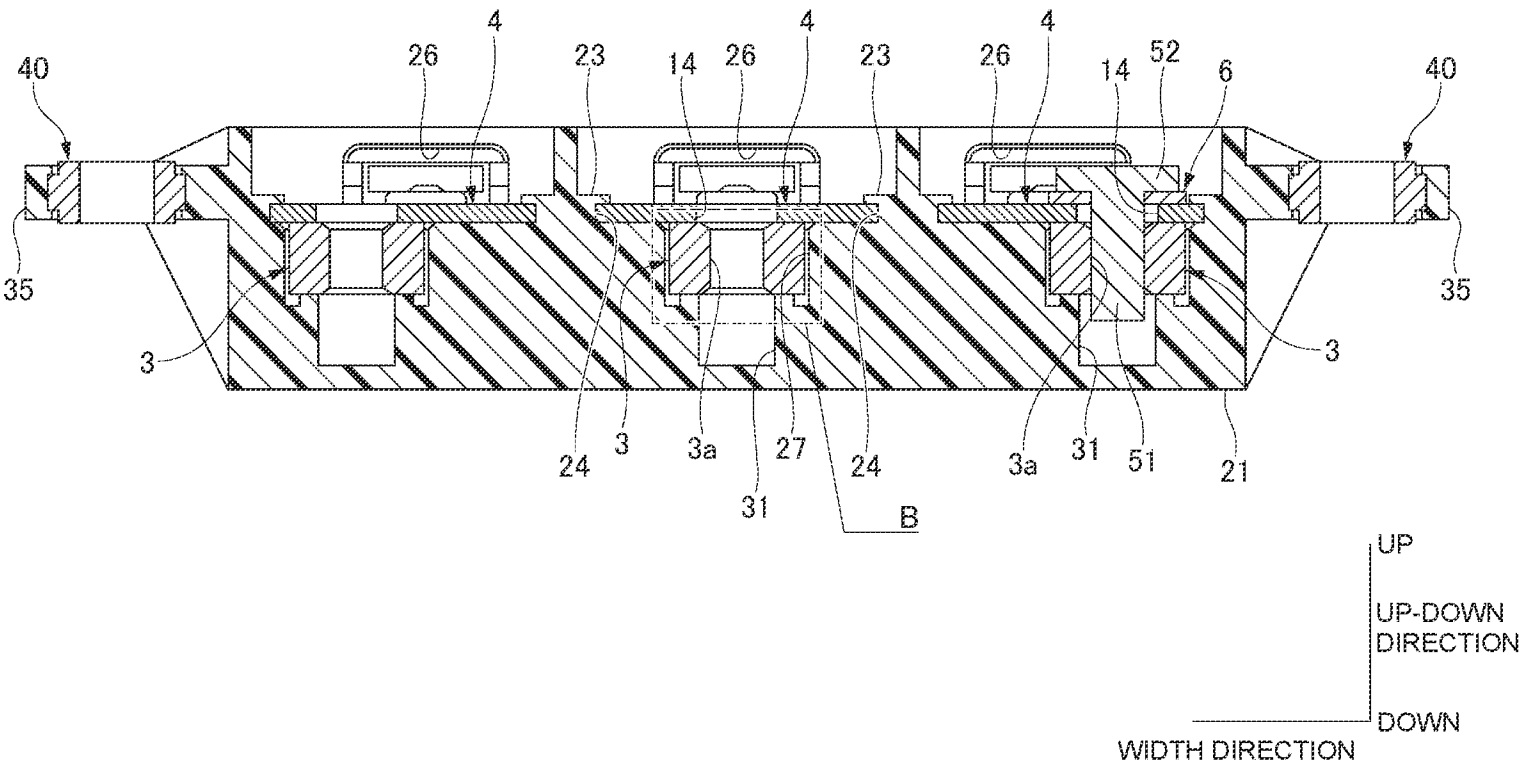
FIG. 3 is a cross-sectional view taken along a line A-A of FIG. 2.
Figure 4:
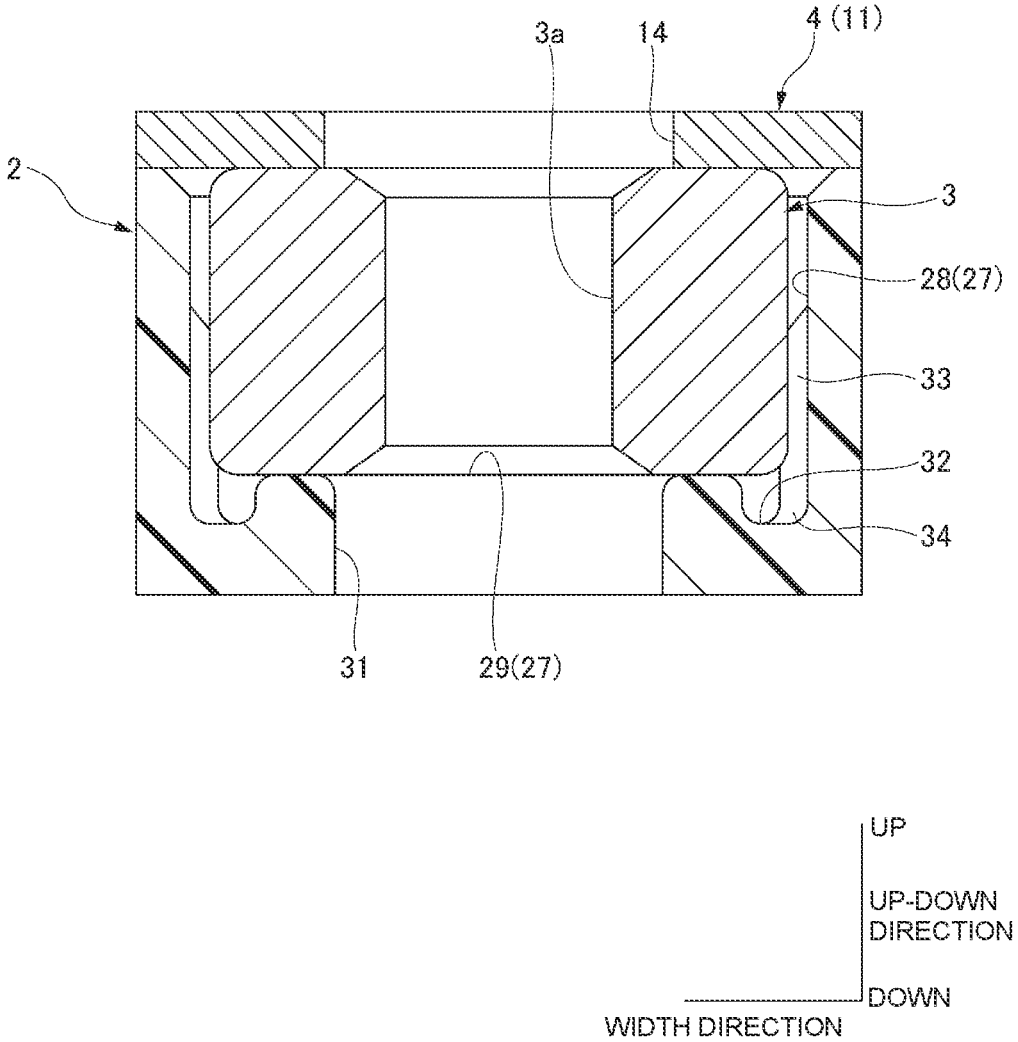
FIG. 4 is an enlarged view of a portion B of FIG. 3.

As shown in FIGS. 1 to 3, the terminal block 1 includes a housing 2 made of resin, a plurality of nuts 3 made of metal press-fitted into a plurality of press-fit grooves 27 (see FIGS. 2 and 3) provided in the housing 2, and a plurality of bus bars 4 made of metal and accommodated in a plurality of bus bar accommodating portions 22 (see FIGS. 1 and 2) provided in the housing 2. Hereinafter, each component forming the terminal block 1 will be described in order.

First, the nut 3 will be described. The nut 3 functions as a part of a component to be used when the terminal 6 is fastened and fixed to the bus bar 4 of the terminal block 1. In this example, the nut 3 is a component made of metal formed by casting, forging, or the like. As shown in FIG. 2, the nut 3 has a rectangular contour shape as viewed in an axial direction of the nut 3, and a bolt fastening hole 3*a* (female screw) penetrating in the axial direction is formed in a center portion of the nut 3. A shaft portion 51 (male screw) of a bolt 5 (see FIG. 1) is attached to the bolt fastening hole 3*a*.

Next, the bus bar 4 will be described. The bus bar 4 has a function of electrically connecting the terminal 6 and the counterpart connector 8. The bus bar 4 as shown in FIG. 2 is firmed by performing press working, bending, or the like on a metal plate. The bus bar 4 includes a contact portion 11, a female terminal portion 12, and a coupling portion 13 coupling the contact portion 11 with the female terminal portion 12. Width dimensions of the female terminal portion 12 and the coupling portion 13 are substantially the same, and a width dimension of the contact portion 11 is larger than the width dimension of the female terminal portion 12 and the coupling portion 13.

The contact portion 11 has a substantially rectangular flat plate shape, and a through hole 14 penetrating in the plate thickness direction is formed at a predetermined portion of the contact portion 11. The contact portion 11 functions as a portion to which the terminal 6 is placed and connected. The shaft portion 51 of the bolt 5 is inserted into the through hole 14.

The female terminal portion 12 has a rectangular cylindrical shape penetrating in the front-rear direction. The female terminal portion 12 functions as a portion to which a counterpart terminal (male terminal) (not shown) belonging to the counterpart connector 8 is inserted and connected.

The coupling portion 13 has a belt-shaped flat plate shape extending in the front-rear direction, and couples the contact portion 11 and a bottom wall portion of the female terminal portion 12 (flat plate shaped portion positioned on a lower side of the rectangular cylindrical shape) without a step in the front-rear direction. Press-fitting protrusions 15 protruding outward in the width direction are formed on both end surfaces in a width direction of the coupling portion 13. When the bus bar 4 is inserted into a through hole 26 (see FIG. 1), which will be described later, of the housing 2, the press-fitting protrusions 15 function as portions that engage with inner walls of the through hole 26 to fix the bus bar 4.

In this example, as shown in FIGS. 1 to 3, three bus bars 4 are disposed side by side in the width direction with respect to one terminal block 1. The three bus bars 4 differ in a position of the through hole 14 in the contact portion 11 and a position in the width direction in which the coupling portion 13 is coupled at the contact portion 11 in accordance with a position where the bus bar 4 is disposed.

Next, the housing 2 will be described. The housing 2 is a resin molded product, and includes, as shown in FIGS. 1 to 3, a substantially rectangular parallelepiped body portion 21 extending in the width direction. Three bus bar accommodating portions 22 for accommodating the three bus bars 4 are recessed side by side in the width direction on an upper face of the body portion 21. Each bus bar accommodating portion 22 is a rectangular recess that is recessed downward and opened rearward and upward.

A pair of protrusions 23 that protrude inward in the width direction and extend in the front-rear direction are formed on inner side surfaces of a pair of side walls extending in the front-rear direction in which the bus bar accommodating portions 22 are partitioned. As a result, as shown in FIG. 3, a pair of grooves 24 are defined between the pair of protrusions 23 and a bottom surface (lower face) of the bus bar accommodating portion 22 on the inner side surfaces of the pair of side walls of each bus bar accommodating portion 22 so as to be recessed outward in the width direction and extend in the front-rear direction. When the bus bar 4 is accommodated in the bus bar accommodating portion 22, a pair of side edge portions extending in the front-rear direction of the contact portion 11 of the bus bar 4 are inserted into the pair of grooves 24.

Three connector portions 25 protrude forward from front walls extending in the width direction partitioning the three bus bar accommodating portions 22 so as to be side by side in the width direction corresponding to the three bus bar accommodating portions 22. The three connector portions 25 are inserted into three connector accommodating holes (not shown) formed on a rear end surface of the counterpart connector 8 when connecting the terminal block 1 and the counterpart connector 8.

The through hole 26 penetrating in the front-rear direction is formed inside each of the connector portions 25 (see FIGS. 1 and 3). The through hole 26 of each connector portion 25 communicates with the corresponding bus bar accommodating portion 22 in the front-rear direction, and a bottom surface (lower face) of the through hole 26 is continuous with the bottom surface of the bus bar accommodating portion 22 without a step. When the bus bar 4 is accommodated in the bus bar accommodating portion 22, the female terminal portion 12 and the coupling portion 13 of the bus bar 4 are inserted into the through hole 26.

As shown in FIGS. 2 and 3, the press-fit groove 27 for press-fitting the nut 3 is formed on the bottom surface of each bus bar accommodating portion 22. Each press-fit groove 27 is formed at a predetermined position on the bottom surface of the corresponding bus bar accommodating portion 22 such that the bolt fastening hole 3*a* of the nut 3 press-fitted into the press-fit groove 27 and the through hole 14 of the bus bar 4 placed on the bus bar accommodating portion 22 are coaxially positioned.

Figure 5:
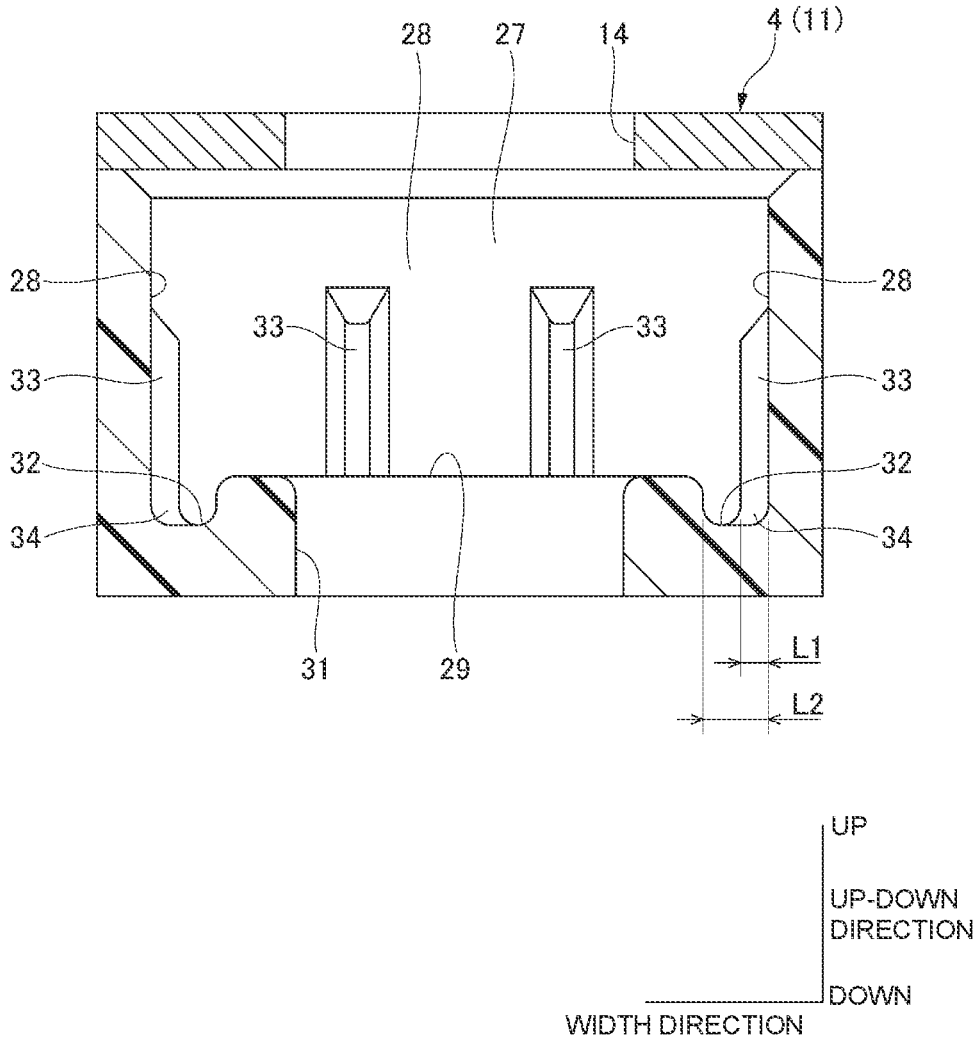
FIG. 5 is a view corresponding to FIG. 4 in which an illustration of the nut is omitted.

Each press-fit groove 27 has a rectangular contour shape corresponding to the contour shape of the nut 3 when viewed in the up-down direction (see FIG. 2), and is, as shown in FIG. 5, a recess that is partitioned by four inner side surfaces 28 and an inner bottom surface 29 and is recessed downward. A clearance groove 31 for allowing entry of a tip end of the shaft portion 51 of the holt 5 is formed so as to be recessed downward at a center position of the inner bottom surface 29 when viewed in the up-down direction (also see FIG. 3).

In a peripheral edge portion of a rectangular frame shape of the inner bottom surface 29 having a rectangular shape, in this example, a recess 32 is formed which is recessed downward and extends along the peripheral edge portion, excluding four corners of the peripheral edge portion as shown in FIG. 5.

A pair of ribs 33 are formed on each of the four inner side surfaces 28 so as to protrude inward of the press-fit groove 27 and extend in the up-down direction. Therefore, a total of eight ribs 33 are disposed so as to sandwich the nut 3 press-fitted into the press-fit groove 27 in the width direction and the front-rear direction. When the nut 3 is press-fitted into the press-fit groove 27, each rib 33 is pressed and brought into contact with the nut 3. Recesses 32 are disposed so that the recesses 32 are positioned on extension lines of all the eight ribs 33. In other words, when viewed from an upper direction, all eight ribs 33 are positioned in a region occupied by the recess 32.

As shown in FIG. 5, a protruding height L1 of the rib 33 from the inner side surface 28 is smaller than an opening width L2 of the recess 32 from the inner side surface 28. A lower end 34 of each rib 33 enters an internal space of the recess 32 and is connected to an innermost surface (bottom surface) of the recess 32. In other words, the lower end 34 of each rib 33 is positioned at a portion closer to the innermost surface (bottom surface) than an opening end of the recess 32. The opening end of the recess 32 is located on an extension line extending from the inner bottom surface 29 of the press-fit groove 27 in the width direction of the housing 2. An upper end surface of each rib 33 is inclined so that a protruding height from the inner side surface 28 becomes smaller toward an upper side. Accordingly, the nut 3 is easily press-fitted into the press-fit groove 27. When the nut 3 is press-fitted into the press-fit groove 27, the nut 3 is accommodated in the press-fit groove 27 in a non-rotatable manner.

As shown in FIG. 1, a pair of attachment portions 35 used when fixing the housing 2 to an object to be attached (for example, a vehicle) are integrally formed on both end surfaces in the width direction of the body portion 21 so as to protrude on both sides in the width direction. A cylindrical collar 40 made of metal is attached to each attachment portion 35. The terminal block 1 is fixed to the object to be attached by fastening and fixing a pair of bolts (not shown) inserted into a pair of collars 40 to the object to be attached. The components forming the terminal block 1 are described above.

Next, an assembling procedure of the terminal block 1 will be described. First, the nut 3 is press-fitted into each press-fit groove 27 of the housing 2. This press-fitting is continued until a bottom surface of the nut 3 comes into contact with the inner bottom surface 29 of the press-fit groove 27 (see FIG. 4). At this time, the nuts 3 are press-fitted into the press-fit grooves 27 while the nuts 3 are pressed and brought into contact with a total of eight ribs 33 provided on the four inner side surfaces 28. There is a case where a resin piece is generated by the rib 33 being scraped by the nut 3 in accordance with the press-fitting.

In this regard, in the terminal block 1, even if such a resin piece is generated, such a resin piece moves so as to approach the recess 32 while being pushed by the nut 3, and is accommodated in the recess 32 provided on the extension line of the rib 33 and recessed downward. That is, by providing the rib 33 in the press-fit groove 27, a portion where the resin piece can be generated can be intentionally controlled, and even if the resin piece is generated, the resin piece can be guided into the recess 32 provided in advance at that portion.

After the press-fitting of the nut 3 into each press-fit groove 27 is completed, the corresponding bus bar 4 is then accommodated in each bus bar accommodating portion 22 of the housing 2. Therefore, the bus bar 4 is pushed forward with respect to the body portion 21, from a state in which the contact portion 11 of the bus bar 4 protrudes rearward from a rear end of the body portion 21 and the female terminal portion 12 and the coupling portion 13 of the bus bar 4 are placed on the bottom surface of the bus bar accommodating portion 22 so as to cover the nut 3 press-fitted into the press-fit groove 27.

Due to the forward pushing of the bus bar 4, the bus bar 4 slides forward while sliding on the bottom surface of the bus bar accommodating portion 22, and the female terminal portion 12 and the coupling portion 13 are inserted into the through hole 26 of the connector portion 25 in this order, and the pair of side edge portions of the contact portion 11 are inserted into the pair of grooves 24 of the bus bar accommodating portion 22. When the coupling portion 13 is inserted into the through hole 26, the pair of press-fitting protrusions 15 provided in the coupling portion 13 are press-fitted into the inner walls of the through hole 26.

When the bus bar 4 reaches a predetermined position in the front-rear direction with respect to the body portion 21, the bus bar 4 is completely accommodated in the bus bar accommodating portion 22. When the bus bar 4 is completely accommodated in the bus bar accommodating portion 22, the contact portion 11 of the bus bar 4 overlaps the nut 3, and the through hole 14 of the contact portion 11 and the bolt fastening hole 3*a* of the nut 3 are coaxially positioned, and the female terminal portion 12 of the bus bar 4 is positioned near a front end opening of the through hole 26 in the through hole 26 of the connector portion 25 (also see FIG. 2).

By press-fitting the pair of press-fitting protrusions 15 into the inner walls of the through hole 26, it is possible to prevent the bus bar 4 from coming off rearward. In addition, since the pair of side edge portions of the contact portion 11 are inserted into the pair of grooves 24 of the bus bar accommodating portion 22, lifting of the bus bar 4 upward can also be prevented. As a result, the bus bar 4 is securely fixed to the predetermined position of the bus bar accommodating portion 22.

Thus, an assembly of the terminal block 1 is completed. Three terminals 6 (see FIG. 1) provided on the terminals of the three electric wires 7 are connected to contact portions 11 of the three bus bars 4 of the completely assembled terminal block 1. In order to connect the terminal 6 to the contact portion 11, the terminal 6 is placed on the contact portion 11, and the shaft portion 51 of the bolt 5 is fastened to the bolt fastening hole 3*a* of the nut 3 with a predetermined torque in a state in which the shaft portion 51 of the bolt 5 extending from a head portion 52 of the bolt 5 is inserted into the through hole 6*a* of the terminal 6 and the through hole 14 of the bus bar 4 from above in this order. Accordingly, the bolt 5 is fastened and fixed to the nut 3, and the terminal 6 is sandwiched between the nut 3 and a washer 50. As a result, the terminal 6 is fixed to the contact portion 11, and the terminal 6 is electrically connected to the contact portion 11.

Further, the counterpart connector 8 (see FIG. 1) is connected to the three connector portions 25 of the completely assembled terminal block 1. In order to connect the counterpart connector 8 to the connector portions 25, the connector portions 25 are inserted into the three connector accommodating holes (not shown) formed in the counterpart connector 8 and fitted. Accordingly, the counterpart terminal (male terminal) (not shown) positioned inside the connector accommodating hole is inserted into the female terminal portion 12 of the bus bar 4 positioned in the through hole 26 of the connector portion 25. As a result, the counterpart terminal is electrically connected to the female terminal portion 12. As described above, the terminal block 1 can function as the relay connector for electrically connecting the plurality of terminals 6 provided on the terminals of the plurality of electric wires 7 and the counterpart connector 8 via the bus bar 4.

<Functions and Effects>

As described above, according to the terminal block 1 of the embodiment of the present disclosure, the rib 33 (in other words, the protrusion) extending along a press-fitting direction (downward) is provided on the inner side surface 28 of the press-fit groove 27 of the housing 2. When the nut 3 is pressed and brought into contact with the rib 33, the nut 3 is press-fitted into the press-fit groove 27. There is a case where a resin piece is generated by the rib 33 being scraped by the nut 3 in accordance with the press-fitting. In the terminal block 1 according to the present embodiment, even if such a resin piece is generated, the resin piece is accommodated in the recess 32 provided on the extension line of the rib 33 and recessed in the press-fitting direction. That is, by providing the rib 33 in the press-fit groove 27, a portion where the resin piece can be generated can be intentionally controlled, and even if the resin piece is generated, the resin piece can be guided into the recess 32 provided in advance at that portion. Therefore, the terminal block 1 according to the present embodiment can prevent scattering of resin pieces that can be generated when the nut 3 is press-fitted into the housing 2.

Further, according to the terminal block 1 of the present embodiment, the recess 32 is provided in the inner bottom surface 29 of the press-tit groove 27. Further, the protruding height L1 of the rib 33 from the inner side surface 28 is smaller than the opening width L2 of the recess 32 from the inner side surface 28 (see FIG. 5). In addition, the end 34 of the rib 33 is positioned between the opening end and the innermost surface of the recess 32 so configured. Accordingly, the resin piece that can be generated when the nut 3 is press-fitted can be guided more properly into the recess 32.

Further, according to the terminal block 1 according to the present embodiment, due to the plurality of ribs 33 (eight in total) disposed so as to sandwich the nuts 3, positional accuracy of the nut 3 can be further increased compared with a case where only one rib 33 is used. Therefore, a position of the through hole 14 of the bus bar 4 and a position of the bolt fastening hole 3*a* of the nut 3 can be matched with higher accuracy. As a result, for example, when the terminal 6 (see FIG. 1) disposed on the bus bar 4 is fastened and fixed to the bus bar 4 with the bolt 5, workability of the fastening and fixing can be improved.

Other Embodiments

The present disclosure is not limited to the above embodiment and various modifications can be adopted within the scope of the present disclosure. For example, the present disclosure is not limited to the above-described embodiment, and may be appropriately modified, improved or the like. In addition, a material, shape, size, number, arrangement position, and the like of each component in the above-described embodiment are optional and are not limited as long as the present disclosure can be achieved.

In the above embodiment, the recess 32 is provided in a region along the rectangular frame shaped peripheral edge portion of the inner bottom surface 29 having the rectangular shape of the press-fit groove 27 excluding the four corners. In contrast, as long as all of the plurality of the ribs 33 (eight in total) are positioned in the region occupied by the recess 32 as viewed from the upper direction, the recess 32 may be provided in any region of the inner bottom surface 29 of the press-fit groove 27.

Further, in the above embodiment, the lower end 34 of the rib 33 is positioned between the opening end and the innermost surface (bottom surface) of the recess 32, in contrast, the lower end 34 of the rib 33 may be positioned above the opening end of the recess 32. Further, the lower end 34 of the rib 33 may be in contact with the innermost surface (bottom surface) of the recess 32.

According to a first aspect of the present disclosure, an electric connection part (1) includes: a nut (3) made of a metal, the nut (3) being used for fixing a conductor (4, 5); and a housing (2) made of a resin, the housing (2) having a press-fit groove (27) into which the nut (3) is press-fitted. The housing (2) includes: a rib (33) that protrudes from an inner side surface (28) of the press-fit groove (27) and extends along a press-fitting direction in which the nut (3) is press-fitted into the press-fit groove (27), such that the rib (33) presses the nut (3) to be in contact with the nut (3); and a recess (32) that is disposed on an extension line in which the rib (33) extends, the recess (32) being recessed in the press-fitting direction.

According to the electric connection part of the first aspect, a rib (that is, a protrusion) extending along the press-fitting direction is provided on the inner side surface of the press-fit groove provided in the housing. When the rib is pressed and brought into contact with the nut, the nut is press-fitted into the press-fit groove. Here, there is a case where a resin piece is generated by the rib being scraped by the nut in accordance with the press-fitting of the nut. On the other hand, since a portion other than the rib is unlikely to come into contact with the nut, generation of the resin piece from such a portion is prevented. Further, in the electric connection part of the present configuration, even if a resin piece is generated from the rib, the resin piece is accommodated in the recess provided on the extension line of the rib and recessed in the press-fitting direction. Thus, by providing the rib having the above structure in the press-fit groove, a portion where the resin piece can be generated can be intentionally controlled, and even if the resin piece is generated, the resin piece can be taken into the recess provided in advance at that portion. Therefore, in the electric connection part of the present configuration, it is possible to prevent scattering of resin pieces that can be generated when the nut is press-fitted into the housing.

According to a second aspect of the present disclosure, the recess (32) may be provided in an inner bottom surface (29) of the press-fit groove (27), and the rib (33) may be configured such that a height (L1) of the rib (33) protruding from the inner side surface (28) is smaller than an opening width (L2) of the recess (32) from the inner side surface (28), and an end (34) of the rib (22) in the press-fitting direction is positioned at a portion closer to an innermost surface of the recess (32) than an opening end of the recess (32).

According to the electric connection part of the second aspect, the recess is provided on the inner bottom surface of the press-fit groove. Further, the protruding height of the rib from the inner side surface is smaller than the opening width of the recess from the inner side surface. In addition, an end of the rib is positioned at a portion closer to the innermost surface than the opening end of the recess. That is, the end of the rib enter the recess. Accordingly, the resin piece that can be generated when the nut is press-fitted can be more properly taken into the recess.

According to a third aspect of the present disclosure, the electric connection part (1) may further include: a bus bar (4) disposed above a bolt fastening hole (3*a*) of the nut (3). The rib (33) may include a plurality of ribs (33). The housing (2) may include the plurality of ribs (33) disposed inside the press-fit groove (27), to sandwich the nut (3) between the plurality of ribs (33), and the bus bar (4) may include a through hole (14) penetrating the bus bar (4) in the press-fitting direction, being disposed such that the through hole (14) and the bolt fastening hole (3*a*) are aligned.

According to the electric connection part the third aspect, due to the plurality of ribs disposed so as to sandwich the nut, it is possible to increase positional accuracy of the nut in the press-tit groove as compared with a case where only one rib is used. Therefore, a position of the through hole of the bus bar and a position of the bolt fastening hole of the nut can be matched with higher accuracy. As a result, for example, when the conductor (for example, terminals provided on terminals of electric wires extending from various electric components) disposed on the bus bar is sandwiched between the bolt and the nut and fastened. and fixed to the bus bar, workability can be improved.

According to another aspect of the present disclosure, the opening end may be located on an extension line extending from an inner bottom surface (29) of the press-fit groove (27) in a width direction of the housing (2).

According to another aspect of the present disclosure, an end (34) of the rib (33) in the press-fitting direction may be in contact with an innermost surface of the recess (32).

According to the present disclosure, it is possible to provide an electric connection part capable of preventing scattering of resin pieces that can be generated when a nut is press-fitted into a housing.

What is claimed is:

1. An electric connection part comprising:

a nut made of a metal, the nut being used for fixing a conductor; and a housing made of a resin, the housing having a press-fit groove into which the nut is press-fitted, wherein the housing includes:

a pair of ribs, each of the ribs protrudes from an inner side surface of the press-fit groove and extends along a press-fitting direction in which the nut is press-fitted into the press-fit groove, such that each of the ribs presses against and contacts the nut;

a recess that is disposed on an extension line in which the ribs extend, the recess being recessed in the press-fitting direction; and an inner bottom surface that is spaced away from the inner side surface of the press-fit groove by the recess, wherein the nut has a bottom surface that opposes the recess and contacts the inner bottom surface of the press-fit groove, and wherein both of the ribs extends into the recess.

2. The electric connection part according to claim 1, wherein each of the ribs is configured such that a height of each of the ribs protruding from the inner side surface is smaller than an opening width of the recess from the inner side surface, and an end of each of the ribs in the press-fitting direction is positioned at a portion closer to an innermost surface of the recess than an opening end of the recess.

3. An electric connection part comprising:

a nut made of a metal, the nut being used for fixing a conductor;

a housing made of a resin, the housing having a press-fit groove into which the nut is press-fitted; and a bus bar disposed above a bolt fastening hole of the nut, wherein the housing includes:

a plurality of ribs disposed inside the press-fit groove, to sandwich the nut between the plurality of ribs, each of the ribs protrudes from an inner side surface of the press-fit groove and extends along a press-fitting direction in which the nut is press-fitted into the press-fit groove, such that each of the ribs presses against and contacts the nut;

a recess that is disposed on an extension line in which the ribs extend, the recess being recessed in the press fitting direction; and an inner bottom surface that is spaced away from the inner side surface of a press fit groove by the recess, wherein the bus bar includes a through hole penetrating the bus bar in the press-fitting direction, being disposed such that the through hole and the bolt fastening hole are aligned, and wherein a pair of the ribs extend into the recess.

4. The electric connection part according to claim 1, wherein an opening end of the recess is located on an extension line extending from the inner bottom surface of the press-fit groove in a width direction of the housing.

5. The electric connection part according to claim 1, wherein an end of each of the ribs in the press-fitting direction is in contact with an innermost surface of the recess.

6. The electric connection part according to claim 1, wherein a clearance groove is recessed downward from the inner bottom surface, and wherein the inner bottom surface separates the clearance groove from the recess.

7. The electric connection part according to claim 1, wherein when viewed from the press-fitting direction, the recess extends along a peripheral edge portion between the inner side surface and the inner bottom surface, excluding corners of the peripheral edge portion.

* * * * *